US006369668B1

(12) United States Patent
Atokawa et al.

(10) Patent No.: US 6,369,668 B1
(45) Date of Patent: Apr. 9, 2002

(54) DUPLEXER AND COMMUNICATION APPARATUS INCLUDING THE SAME

(75) Inventors: Masayuki Atokawa; Nobuyoshi Honda, both of Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/344,055

(22) Filed: Jun. 25, 1999

(30) Foreign Application Priority Data

Jun. 25, 1998 (JP) ..... 10-178767

(51) Int. Cl.[7] ..... H01P 5/12; H01P 7/04; H01P 1/20; H01P 1/213

(52) U.S. Cl. ..... 333/134; 333/206; 333/222

(58) Field of Search ..... 333/134, 202, 333/203, 206, 207, 222, 223

(56) References Cited

U.S. PATENT DOCUMENTS 5,412,359 A * 5/1995 Kazama et al. ..... 333/206

6,085,071 A * 7/2000 Yamada et al. ..... 455/82

* cited by examiner

*Primary Examiner*—Benny Lee
*Assistant Examiner*—Kimberly Glenn
(74) *Attorney, Agent, or Firm*—Ostrolenk, Faber, Gerb & Soffen, LLP

(57) ABSTRACT

A duplexer comprising: λ/4-type dielectric coaxial resonators constituting a transmitting-side filter; λ/4-type dielectric coaxial resonators constituting a receiving-side filter; and coupling elements for coupling said resonators; wherein the dielectric coaxial resonators constituting the transmitting-side filter and the dielectric coaxial resonators constituting the receiving-side filter are placed in parallel; and the open end surfaces of the dielectric coaxial resonators constituting the transmitting-side filter and the open end surfaces of the dielectric coaxial resonators constituting the receiving-side filter are disposed in opposite directions, and/or are alternately disposed side-by-side.

6 Claims, 3 Drawing Sheets

DUPLEXER AND COMMUNICATION APPARATUS INCLUDING THE SAME

BACKGROUND OF THE INVENTION

1. Field of the Invention

The present invention relates to a duplexer and a communication apparatus for use in a microwave band, for example, a mobile phone or the like.

2. Description of the Related Art

A known duplexer comprising dielectric coaxial resonators has a structure shown in FIG. 5.

This duplexer includes a transmitting-side which comprises a band-elimination filter having four λ/4-type dielectric coaxial resonators R1 through R4 and a receiving-side which comprises a band-pass filter having four λ/4-type dielectric coaxial resonators R5 through R8.

Here, "a λ/4-type dielectric coaxial resonator" means a dielectric coaxial resonator adapted to resonate at a frequency and having a length which is a quarter wavelength at that frequency. To obtain such dielectric coaxial resonator, one end surface of the dielectric coaxial resonator is made electrically open-circuited (i.e., the open end surface), and the other end surface of the dielectric coaxial resonator is made electrically short-circuited (i.e., the short end surface).

The open end surfaces of the dielectric coaxial resonators R1 through R4 constituting the transmitting-side filter are arranged side by side substantially on the left-half side of a base substrate 2 and the open end surfaces of the dielectric coaxial resonators R5 through R8 constituting the receiving-side filter are arranged side by side substantially on the right-half of the same in such a manner that the open end surfaces of both sides are disposed in the same direction and their axes are in parallel to each other. Capacitors C, air-core coils L, and the coupling substrate 3 are disposed on the side of the open end surfaces of the resonators R1 through R8 provided on the base substrate 2; and the resonators R1 through R8 are coupled by the coupling elements such as the capacitors C, the air-core coils L, and capacitors provided on the base substrate 2 and the coupling substrate 3, through a connection terminal 4 connected to an inner conductor of each resonator. The resonators R1, R4, R5, and R8, which are input-output units, are connected to a transmission terminal 6, which is an input-output terminal on the transmitting side formed on the base substrate 2, a reception terminal 7, which is an input-output terminal on the receiving side, and an antenna terminal 8 sharing the input-output terminals of the transmitting side and the receiving side, directly or through a coupling element.

Recently, small, lightweight, and thin types of radio communication apparatus such as mobile phones have been rapidly spreading. With this trend, a duplexer which is used in this type of radio communication apparatus, is required to be small, lightweight, and thin, so that the size of a dielectric coaxial resonator used in a duplexer, recently 4 mm square or 3 mm square, is becoming smaller year by year, to as small as 2 mm square.

However, in the above described duplexer, the open end surfaces of all the dielectric coaxial resonators are on the same side. When a smaller dielectric coaxial resonator is used to achieve miniaturization of a duplexer, since the smaller the size of the dielectric coaxial resonator, the smaller the area on which coupling elements can be mounted for coupling the resonators, it is impossible to dispose a coupling element having a specified configuration or a specified value.

Specifically, when the size of the dielectric coaxial resonator is modified from 3 mm square to 2 mm square, the dimension of the available area for arranging the dielectric coaxial resonators side by side is reduced by a third, and the distance between the resonators is reduced by a third, so that it is impossible to use an air-core coil, a coupling substrate and the like, which are used in a 3 mm-square resonator, in a duplexer formed of 2 mm-square resonators. In contrast, when the air-core coil, the coupling substrate, and the like, are made smaller corresponding to the distance between the resonators, it is impossible to obtain inductance and capacitance of a desired value or desired characteristics. Worse, variations in the characteristics increase. In addition, in the above conventional duplexer, the reception terminal, the transmission terminal, and the antenna terminal are formed close to one side of the base substrate, so that when it is miniaturized, the distances between the terminals are shorter; thereby, signal leakage, due, for example to capacitive coupling between terminals or an actual arc caused by dielectric breakdown between terminals, may occur between the transmission terminal and the antenna terminal or between the reception terminal and the antenna terminal, so that sufficient isolation cannot be obtained.

In other words, in the structure of the above described duplexer, when smaller dielectric coaxial resonators are used to achieve miniaturization of the duplexer, the characteristics can greatly deteriorate and the characteristic variations can increase.

SUMMARY OF THE INVENTION

To overcome the above described problems, preferred embodiments of the present invention provide a duplexer and a communication apparatus, which are small, low-cost, and have satisfactory characteristics.

One preferred embodiment of the present invention provides a duplexer comprising: λ/4-type dielectric coaxial resonators constituting a transmitting-side filter; λ/4-type dielectric coaxial resonators constituting a receiving-side filter; and coupling elements for coupling said resonators; wherein the dielectric coaxial resonators constituting the transmitting-side filter and the dielectric coaxial resonators constituting the receiving-side filter are placed in parallel; and the open end surfaces of the dielectric coaxial resonators constituting the transmitting-side filter and the open end surfaces of the dielectric coaxial resonators constituting the receiving-side filter are disposed in opposite directions.

Another preferred embodiment of the present invention provides a duplexer comprising: λ/4-type dielectric coaxial resonators constituting a transmitting-side filter; λ/4-type dielectric coaxial resonators constituting a receiving-side filter; and coupling elements for coupling said resonators; wherein the respective dielectric coaxial resonators are placed side by side in such a manner that at least one of the dielectric coaxial resonators constituting either one of filters is disposed between the dielectric coaxial resonators constituting the other of the filters; and the open end surfaces of the dielectric coaxial resonators constituting the transmitting-side filter and the open end surfaces of the dielectric coaxial resonators constituting the receiving-side filter are disposed in opposite directions.

Still another preferred embodiment of the present invention provides a duplexer comprising: λ/4-type dielectric coaxial resonators constituting a transmitting-side filter; λ/4-type dielectric coaxial resonators constituting a receiving-side filter; and coupling elements for coupling said resonators; wherein the respective ones of the dielectric coaxial resonators constituting the transmitting-side filter and the respective ones of the dielectric coaxial resonators constituting the receiving-side filter are alternately disposed side by side; and the open end surfaces of the dielectric coaxial resonators constituting the transmitting-side filter and the open end surfaces of the dielectric coaxial resonators constituting the receiving-side filter are disposed in opposite directions.

Yet another preferred embodiment of the present invention provides a communication apparatus comprising the above described duplexer.

In the duplexer having the above-described structure, the respective dielectric coaxial resonators are disposed in parallel in such a manner that the open end surfaces of the dielectric coaxial resonators forming the transmitting-side filter and the open end surfaces of the dielectric coaxial resonators forming the receiving-side filter are disposed in opposite directions. This arrangement permits coupling elements connected to the dielectric coaxial resonators of the transmitting-side filter and coupling elements connected to the dielectric coaxial resonators of the receiving-side filter to be respectively disposed on the opposite sides, with respect to the resonator length direction of the dielectric coaxial resonators, so that the width and the area for mounting the coupling elements can be substantially expanded. Thus, even if smaller dielectric coaxial resonators are used, coupling elements having the same configuration as those used in the conventional large-size dielectric coaxial resonators can be used. Or coupling elements having satisfactory characteristics, and having fewer variations in the characteristics, can be used. In this case, changing the order in which the dielectric coaxial resonators are disposed permits coupling elements having more appropriate configurations and characteristics to be used.

Disposition of the dielectric coaxial resonators constituting the transmitting-side filter and the dielectric coaxial resonators constituting the receiving-side filter in alternating directions permits the dimensions of the dielectric coaxial resonators forming the duplexer to be even, and longer, and permits the use of coupling elements having the most appropriate configurations and characteristics.

In other words, flexibility is increased as to the sizes of the coupling elements, and it thereby becomes possible to use coupling elements having better characteristics and commonality.

In addition, since the antenna terminal can be provided on the side opposite to the side on which the transmission terminal and the reception terminal are provided, and the distances between the terminals can be kept sufficiently large, occurrence of signal-hops between the transmission terminal and the antenna terminal or between the reception terminal and the antenna terminal can be prevented so as to ensure sufficient isolation between the transmitting-side filter and the receiving-side filter.

Furthermore, since the communication apparatus according to the present invention is formed by including the duplexer having the above characteristics, it can be smaller and low-cost, and can have satisfactory characteristics.

Other features and advantages of the present invention will become apparent from the following description of embodiments of the invention which refers to the accompanying drawings.

DETAILED DESCRIPTION OF EMBODIMENTS OF THE INVENTION

Figure 1:
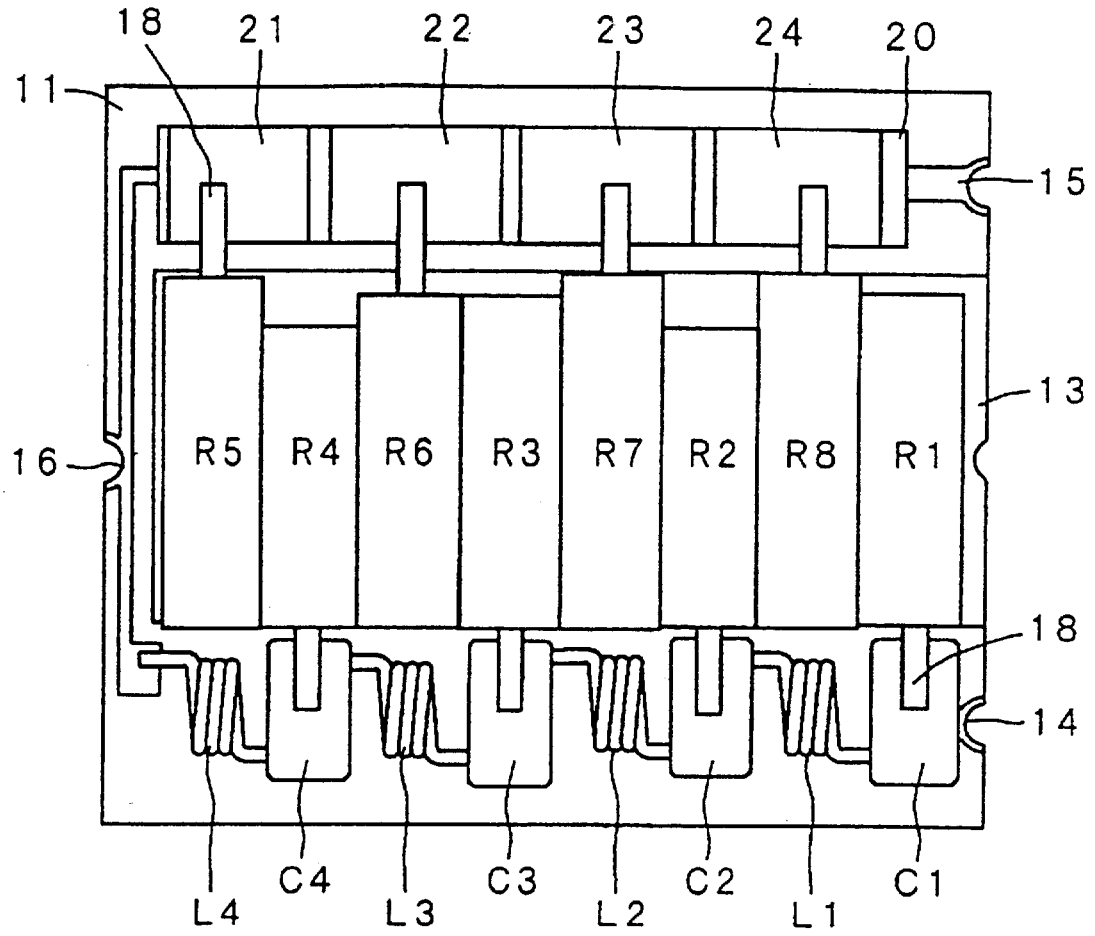
FIG. 1 is a plan view of a duplexer according to a first preferred embodiment of the present invention.

Referring to FIG. 1, the duplexer of the embodiment has eight dielectric coaxial resonators R1 through R8, a coupling substrate 20, capacitors C1 through C4, and air-core coils L1 through L4 disposed on a base substrate 11 formed of dielectric. The dielectric coaxial resonators R1 through R4 are resonators constituting a transmitting-side filter and the dielectric coaxial resonators R5 through R8 are resonators constituting a receiving-side filter.

The dielectric coaxial resonators R1 through R8 have an arrangement in which a through-hole is made in a dielectric block of rectangular parallelepiped form; an outer conductor is formed on an outer surface of the dielectric block; and an inner conductor is provided on the inner surface of the through-hole. They are the so-called one-end-open $\lambda/4$-type dielectric coaxial resonators, in which the inner conductor is separated from the outer conductor at one end of the through-hole, whereas it is short-circuited with the outer conductor at the other end.

The dielectric coaxial resonators R1 through R4 constituting the transmitting-side filter and the dielectric coaxial resonators R5 through R8 constituting the receiving-side filter are disposed alternately one by one in parallel in such a manner that the axes of the resonator length directions are mutually parallel. In FIG. 1, the dielectric coaxial resonators R1 through R4 are disposed in such a manner that their open end surfaces are on the lower side, whereas the dielectric coaxial resonators R5 through R8 are disposed in such a manner that their open end surfaces are on the upper side. In other words, the open end surfaces of the dielectric coaxial resonators R1 through R4 constituting the transmitting-side filter and the open end surfaces of the dielectric coaxial resonators R5 through R8 constituting the receiving-side filter are arranged to be in respective directions which are 180 degrees apart. In addition, in order to miniaturize, the dielectric coaxial resonators R1 through R8 are disposed to contact each other closely.

The capacitors C1 through C4 and the air-core coils L1 through L4 for obtaining coupling of the transmitting-side filter are arranged on the lower part of the base substrate 11 as seen in FIG. 1, which is near the open end surfaces of the dielectric coaxial resonators R1 through R4, whereas the coupling substrate 20 for obtaining coupling of the receiving-side filter is arranged on the upper part of the base substrate 11, which is near the open end surfaces of the dielectric coaxial resonators R5 through R8.

More specifically, a ground electrode 13 is provided on substantially the central part of the upper surface of the base substrate 11 and on substantially the entire lower surface, and the dielectric coaxial resonators R1 through R8 are connected to the ground electrode 13 on the upper surface of the base substrate 11 by soldering or the like.

Figure 2:
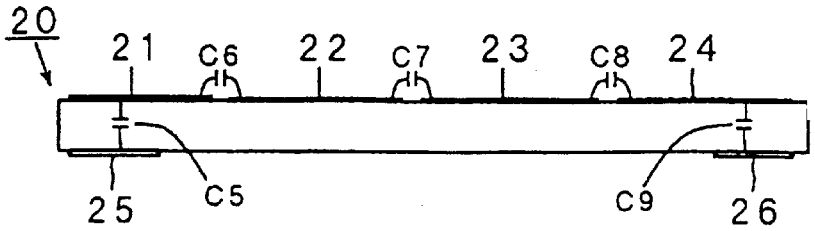
FIG. 2 is a side view of a coupling substrate of the duplexer shown in FIG. 1.

The capacitors C1 through C4 are single-plate capacitors, in which an electrode is provided on the upper and lower surfaces of a dielectric plate; and electrodes (omitted in the figure) having substantially the same size as that of the capacitors C1 through C4 are respectively provided on the parts where the capacitors C1 through C4 are disposed on the upper surface of the base substrate 11. The coupling substrate 20 is formed of dielectric, and as shown in FIG. 2, electrodes 21 through 24 for coupling the resonators are formed on the upper surface, whereas electrodes 25 and 26 for external coupling are formed on the lower surface. Capacitors C6 through C8 are provided between respective ones of the electrodes 21 through 24; a capacitor C5 is provided between the electrode 21 and an electrode 25; and a capacitor C9 is formed between the electrode 24 and an electrode 26.

On one side surface of the base substrate 11, a transmission terminal 14 comprising an electrode-film is connected to the electrode on the lower surface of the capacitor C1 and a reception terminal 15 comprising an electrode-film is connected to the electrode 26 of the coupling substrate 20. An antenna terminal 16 comprising an electrode-film is provided on the opposite side surface. The antenna terminal 16 is connected at one end to the coil L4 and is connected at the other end to the electrode 25 of the coupling substrate 20. The transmission terminal 14, the reception terminal 15, and the antenna terminal 16 are extended across the end surface of the base substrate and onto the lower surface of the same so as to permit surface-mounting.

The inner conductors of the dielectric coaxial resonators R1 through R4 of the transmitting-side filter are respectively connected to the upper-surface electrodes of the capacitors C1 through C4 by respective metallic connection terminals 18; the air-core coils L1 through L3 are connected between the capacitors C1 through C4; and the air-core coil L4 is connected between the capacitor C4 and the antenna terminal 16. The inner conductors of the dielectric coaxial resonators R5 through R8 of the receiving-side filter are respectively connected to the electrodes 21 through 24 on the coupling substrate 20 by metallic connection terminals 18.

Figure 3:
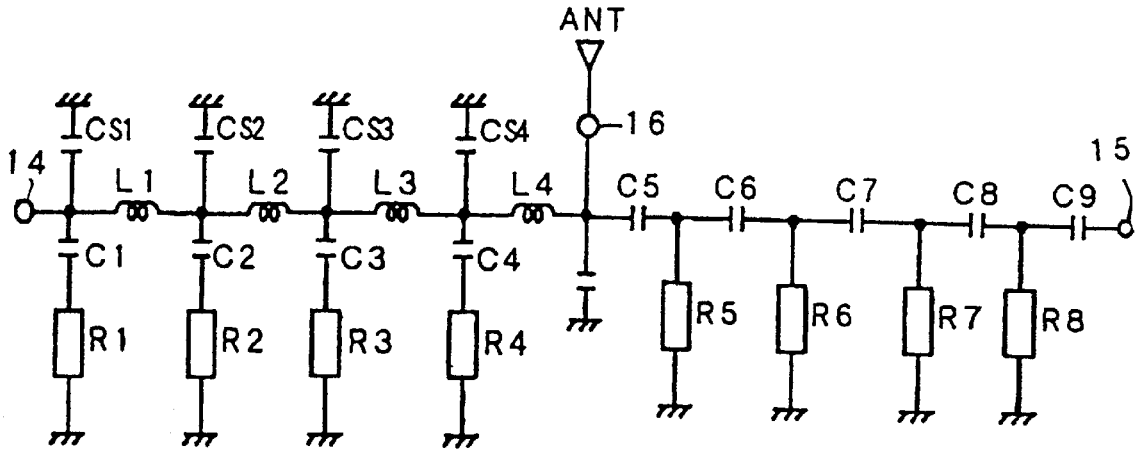
FIG. 3 is an equivalent circuit diagram of the duplexer shown in FIG. 1.

FIG. 3 is an equivalent circuit diagram of the duplexer. The resonators R1 through R8, the capacitors C1 through C9, and the inductors L1 through L4 are equivalent to those shown in FIG. 1 and FIG. 2. Capacitors CS1 through CS4 are provided between the electrodes on the lower surfaces of the capacitors C1 through C4 on the base substrate 11 and the ground electrode provided on the upper surface of the base substrate 11. On the transmitting side, a band elimination filter is made with the dielectric coaxial resonators R1 through R4, the capacitors C1 through C4, CS1 through CS4, and the inductors L1 through L4, which couple these resonators, whereas on the receiving side, a band pass filter is made with the dielectric coaxial resonators R5 through R8, and the capacitors C5 through C9 coupling these resonators.

In the above described embodiment, the open end surfaces of the dielectric coaxial resonators constituting the transmitting-side filter and the open end surfaces of the dielectric coaxial resonators constituting the receiving-side filter are disposed in opposite directions; and the coupling elements such as the capacitors and the inductors, which couple each filter, are arranged on both sides of the dielectric coaxial resonators.

Figure 5:
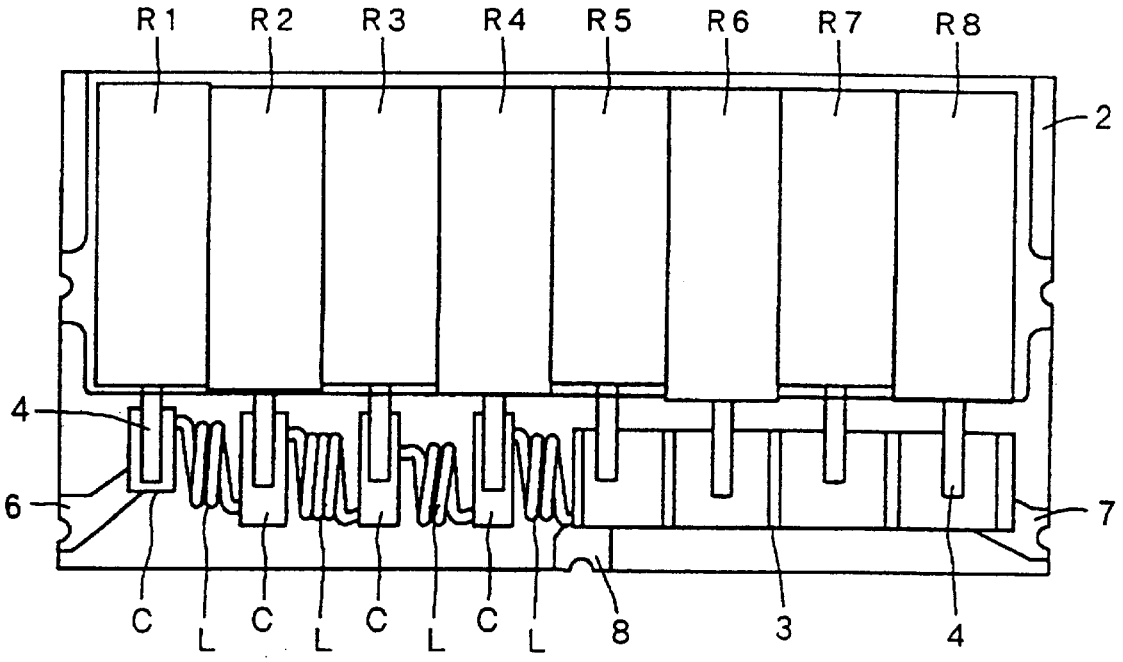
FIG. 5 PRIOR ART
FIG. 5 is a plan view of a prior art duplexer.

Furthermore, the dielectric coaxial resonators constituting the transmitting-side filter and the dielectric coaxial resonators constituting the receiving-side filter are disposed alternately one by one; whereby the dimensions of the coupling elements constituting the filters are permitted to be larger than those of the conventional art shown in FIG. 5. For example, when dielectric coaxial resonators having the same size are used, in the arrangement of the embodiment, the overall width dimension in which coupling elements can be mounted and the overall dimension of the resonators constituting the same filter are twice as long as in the arrangement of the conventional art.

In other words, in this embodiment, even when the duplexer is miniaturized by using smaller-size dielectric coaxial resonators, coupling elements having the same configuration and the same characteristics as those used in large-size dielectric coaxial resonators can be used. That is, the equivalent coupling element can be used even if the size of the dielectric coaxial resonator is reduced by half. Thus, even if the size of the dielectric coaxial resonator is reduced by half, it is possible to use a coupling element, which has better characteristics and fewer variations in its characteristics than those of the conventional structure.

Thus, even when a smaller dielectric coaxial resonator is used, a duplexer can be formed using coupling elements, which have no characteristic degradation, so that a duplexer which is small-sized and has satisfactory characteristics can be easily obtained. In addition, it is possible to achieve commonality of coupling elements so as to reduce the number of different kinds of coupling elements required, whereby part-inspection costs can be reduced.

In this embodiment, the antenna terminal is disposed on the side opposite to the side on which the transmitting-side terminal and the receiving-side terminal are provided; and the distance between the respective terminal electrodes, which are used for input-output of signals, is arranged in such a manner that they are in the most distant position from each other. Disposing the input-output terminals in this way prevents occurrence of signal-hops between the terminals so as to ensure isolation between the transmitting-side filter and the receiving-side filter.

In the above embodiment, although a description has been provided of a duplexer using the same number (four) of dielectric coaxial resonators constituting each of the transmitting-side filter and the receiving-side filter, it may be possible to make the transmitting-side filter and the receiving-side filter with different numbers of dielectric coaxial resonators. In this case, if the difference between the respective numbers of dielectric coaxial resonators is one, it is still possible to dispose the dielectric coaxial resonators constituting the respective filters in alternating directions in such a manner that their respective open end surfaces are placed in the opposite directions, similar to the case of the first embodiment, so as to obtain the same advantages as those in the first embodiment. In addition, even when the difference between the numbers of the dielectric coaxial resonators is two or more, it is possible to dispose them in such a manner as to increase as much as possible the number of alternately disposed pairs, so as to permit the use of coupling elements having better characteristics.

Furthermore, in the above embodiment, a description has been provided of disposing the respective dielectric coaxial resonators constituting the transmitting-side filter and the respective dielectric coaxial resonators constituting the receiving-side filter alternately. However, the structure should not be limited to this case, and it may be also possible to have an arrangement wherein the open end surfaces of only the dielectric coaxial resonators constituting the transmitting-side filter, or the open end surfaces of only the dielectric coaxial resonators constituting the receiving-side filter, are arranged in alternating directions. Or it may be possible to arrange the dielectric coaxial resonators constituting the transmitting-side filter and the dielectric coaxial resonators constituting the receiving-side filter in a different sequence, if necessary, depending on the configurations of the coupling elements that are used, or to accommodate different means for coupling the dielectric coaxial resonators. In this case, since it is also possible to dispose coupling elements on both sides of a plurality of the dielectric coaxial resonators placed in parallel, when small-size dielectric coaxial resonators are used to achieve miniaturization of the duplexer, coupling elements having appropriate characteristics can be used, and thus due emphasis is given to the characteristics and the commonality of the components.

Since the antenna terminal, the transmission terminal, and the reception terminal can be disposed in mutually distant positions, it is possible to ensure isolation between the transmitting-side filter and the receiving-side filter.

The outline of the dielectric coaxial resonator and the configuration of the through-hole should not be limited to those of the above embodiment. The outline of a circular-formed section and the through-hole of quadrangular-sectional form may be applicable.

Although the transmitting-side filter is a band elimination filter in the above embodiment, the transmitting-side filter may be a band pass filter.

In addition, in the above embodiment, the dielectric coaxial resonators and the coupling elements have been arranged on the base substrate formed of dielectric. However, each member may be disposed in a metallic case. In this case, the coupling elements of the transmitting-side filter can be formed by using a coupling substrate.

The methods for forming the coupling elements and the kinds of coupling elements should not be limited to those of the above embodiment. For example, it may be possible to use a chip capacitor and a chip coil; and an inductor may be formed by an electrode pattern.

Figure 4:
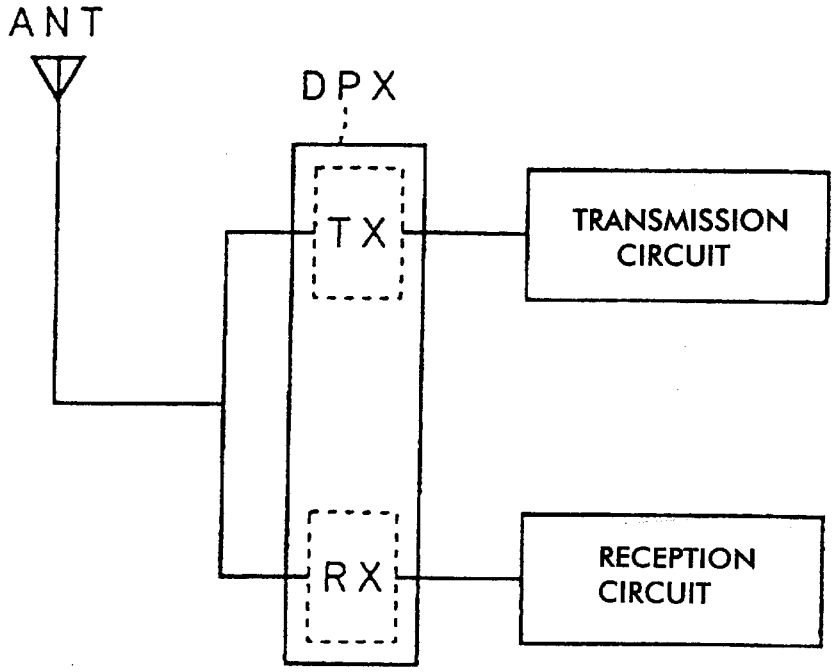
FIG. 4 is a block diagram of a communication apparatus according to a second preferred embodiment of the present invention.

FIG. 4 shows a structure of a communication apparatus according to a second preferred embodiment of the present invention. In FIG. 4, ANT is an antenna, DPX is a duplexer, TX is a transmitting-side filter, and RX is a receiving-side filter. The output end of the transmitting-side filter TX is connected to the antenna ANT and the input end is connected to a transmission circuit, whereas the input end of the receiving-side filter RX is connected to the antenna ANT and the output end is connected to a reception circuit, so as to form the communication apparatus.

In this case, the duplexer shown in FIG. 1 of the first embodiment can be used as the duplexer DPX. Using the duplexer according to the present invention permits obtaining of a communication apparatus, which is small and has good characteristics.

While the invention has been particularly shown and described with reference to preferred embodiments thereof, it will be understood by those skilled in the art that the foregoing and other changes in form and details may be made therein without departing from the spirit of the invention.

What is claimed is:

1. A duplexer comprising:

λ/4-type dielectric coaxial resonators having open end surfaces and short end surfaces constituting a transmitting-side filter; a first coupling element which couples said resonators of said transmitting-side filter; λ/4-type dielectric coaxial resonators having open end surfaces and short end surfaces constituting a receiving-side filter; and a second coupling element which couples said resonators of said receiving-side filter;

wherein all of the respective dielectric coaxial resonators constituting the transmitting-side filter and all of the respective dielectric coaxial resonators constituting the receiving-side filter are alternately disposed side by side;

the open end surfaces of the respective dielectric coaxial resonators constituting the transmitting-side filter are disposed in opposite directions from the open end surfaces of the respective dielectric coaxial resonators constituting the receiving-side filter;

the first coupling element is arranged adjacent the open-end-surface side of the dielectric coaxial resonators constituting the transmitting-side filter and remote from the open-end-surface side of the receiving-side filter;

the second coupling element is arranged adjacent the open-end-surface side of the dielectric coaxial resonators constituting the receiving-side filter and remote from the open-end-surface side of said transmitting-side filter;

the second coupling element comprises an inductor; and the inductor is arranged adjacent to the short end surface of the dielectric coaxial resonators constituting the receiving-side filter.

2. The duplexer according to claim 1, wherein the first coupling element comprises a capacitor and the second coupling element further comprises a capacitor.

3. A communication apparatus comprising:

a duplexer which comprises λ/4-type dielectric coaxial resonators having open end surfaces and short end surfaces constituting a transmitting-side filter; a first coupling element which couples said resonators of said transmitting-side filter; λ/4-type dielectric coaxial resonators having open end surfaces and short end surfaces constituting a receiving-side filter; and a second coupling element which couples said resonators of said receiving-side filter;

wherein all of the respective dielectric coaxial resonators constituting the transmitting-side filter and all of the respective dielectric coaxial resonators constituting the receiving-side filter are alternately disposed side by side;

the open end surfaces of the respective dielectric coaxial resonators constituting the transmitting-side filter are disposed in opposite directions from the open end surfaces of the respective dielectric coaxial resonators constituting the receiving-side filter;

a transmission circuit connected to said transmitting-side filter; and a reception circuit connected to said receiving-side filter;

wherein the first coupling element is arranged adjacent the open-end-surface side of the dielectric coaxial resonators constituting the transmitting-side filter and remote from the open-end-surface side of the receiving-side filter;

wherein the second coupling element is arranged adjacent the open-end-surface side of the dielectric coaxial resonators constituting the receiving-side filter and remote from the open-end-surface side of said transmitting-side filter;

the second coupling element comprises an inductor; and the inductor is arranged adjacent to the short end surface of the dielectric coaxial resonators constituting the receiving-side filter.

4. The communication apparatus according to claim 3, wherein the first coupling element comprises a capacitor and the second coupling element further comprises a capacitor.

5. A duplexer comprising:

λ/4-type dielectric coaxial resonators having open end surfaces and short end surfaces constituting a transmitting-side filter; a first coupling element which couples said resonators of said transmitting-side filter; λ/4-type dielectric coaxial resonators having open end surfaces and short end surfaces constituting a receiving-side filter; and a second coupling element which couples said resonators of said receiving-side filter;

wherein all of the respective dielectric coaxial resonators constituting the transmitting-side filter and all of the respective dielectric coaxial resonators constituting the receiving-side filter are alternately disposed side by side;

the open end surfaces of the respective dielectric coaxial resonators constituting the transmitting-side filter arc disposed in opposite directions from the open end surfaces of the respective dielectric coaxial resonators constituting the receiving-side filter;

the first coupling element is arranged adjacent the open-end-surface side of the dielectric coaxial resonators constituting the transmitting-side filter and remote from the open-end-surface side of the receiving-side filter;

the second coupling element is arranged adjacent the open-end-surface side of the dielectric coaxial resonators constituting the receiving-side filter and remote from the open-end-surface side of said transmitting-side filter;

the first coupling element comprises a capacitor and the second coupling element comprises a capacitor and an inductor; and the inductor is arranged adjacent to the short end surface of the dielectric coaxial resonators constituting the receiving-side filter.

6. A communication apparatus comprising:

a duplexer which comprises λ/4-type dielectric coaxial resonators having open end surfaces and short end surfaces constituting a transmitting-side filter; a first coupling element which couples said resonators of said transmitting-side filter; λ/4-type dielectric coaxial resonators having open end surfaces and short end surfaces constituting a receiving-side filter; and a second coupling element which couples said resonators of said receiving-side filter;

wherein all of the respective dielectric coaxial resonators constituting the transmitting-side filter and all of the respective dielectric coaxial resonators constituting the receiving-side filter are alternately disposed side by side;

the open end surfaces of the respective dielectric coaxial resonators constituting the transmitting-side filter are disposed in opposite directions from the open end surfaces of the respective dielectric coaxial resonators constituting the receiving-side filter;

a transmission circuit connected to said transmitting-side filter; and a reception circuit connected to said receiving-side filter;

wherein the first coupling element is arranged adjacent the open-end-surface side of the dielectric coaxial resonators constituting the transmitting-side filter and remote from the open-end-surface side of the receiving-side filter;

wherein the second coupling element is arranged adjacent the open-end-surface side of the dielectric coaxial resonators constituting the receiving-side filter and remote from the open-end-surface side of said transmitting-side filter;

the first coupling element comprises a capacitor and the second coupling element comprises a capacitor and an inductor; and the inductor is arranged adjacent to the short end surface of the dielectric coaxial resonators constituting the receiving-side filter.

* * * * *